299-13 SR
10/7/80 OR 4,226,475

United States Patent [19]

Frosch et al.

[11] 4,226,475

[45] Oct. 7, 1980

[54] UNDERGROUND MINERAL EXTRACTION

[76] Inventors: Robert A. Frosch, Administrator of the National Aeronautics and Space Administration, with respect to an invention of; Charles G. Miller, Pasadena; James B. Stephens, La Crescenta, both of Calif.

[21] Appl. No.: 897,832

[22] Filed: Apr. 19, 1978

[51] Int. Cl.[3] ..... E21C 25/60; E21C 5/00

[52] U.S. Cl. ..... 299/13; 166/222; 166/77; 134/17; 299/17; 299/20; 239/562; 239/591

[58] Field of Search ..... 175/38, 56, 45, 422; 166/222, 223, 77; 239/562, 591; 134/17; 299/17, 13, 20; 102/21.6, 21, 23

[56] References Cited

U.S. PATENT DOCUMENTS

| | | | |
|---|---|---|---|
| 2,703,145 | 3/1955 | Hildebrandt | 166/222 |
| 3,155,177 | 11/1964 | Fly | 175/38 |
| 3,156,584 | 11/1964 | Yurdin | 134/17 |
| 3,195,634 | 7/1965 | Hill | 166/308 |
| 3,251,424 | 5/1966 | Brooks | 175/56 |
| 3,302,720 | 2/1967 | Brandon | 175/56 |
| 3,664,422 | 5/1972 | Bullen | 166/302 |
| 3,744,579 | 7/1973 | Godfrey | 299/17 |
| 3,856,095 | 12/1974 | Adair | 175/422 |
| 3,873,156 | 3/1975 | Jacoby | 175/61 |
| 3,876,016 | 4/1975 | Stinson | 175/45 |
| 3,900,226 | 8/1975 | de Jong | 299/17 |
| 3,907,366 | 9/1975 | Pender | 299/30 |
| 3,964,792 | 6/1976 | Archibald | 299/13 |
| 4,079,999 | 3/1978 | Grimley | 299/17 |

*Primary Examiner*—William F. Pate, III
*Attorney, Agent, or Firm*—Monte F. Mott; John R. Manning; Wilfred Grifka

[57] ABSTRACT

A method for extracting an underground mineral such as coal, which avoids the need for sending personnel underground and which enables the mining of steeply pitched seams of the mineral. The method includes the use of a narrow vehicle which moves underground along the mineral seam and which is connected by pipes or hoses to water pumps at the surface of the earth. The vehicle hydraulically drills pilot holes during its entrances into the seam, and then directs sideward jets at the seam during its withdrawal from each pilot hole to comminute the mineral surrounding the pilot hole and combine it with water into a slurry, so that the slurried mineral can flow down to a location where a pump raises the slurry to the surface. Droplets of liquid carbon dioxide or other suitable material may be added to the water prior to its exit from a jet nozzle on the vehicle, so that as the water pressure drops in movement through the nozzle the liquid carbon dioxide or other material explodes into a vapor to greatly increase the velocity of the water jet.

20 Claims, 11 Drawing Figures

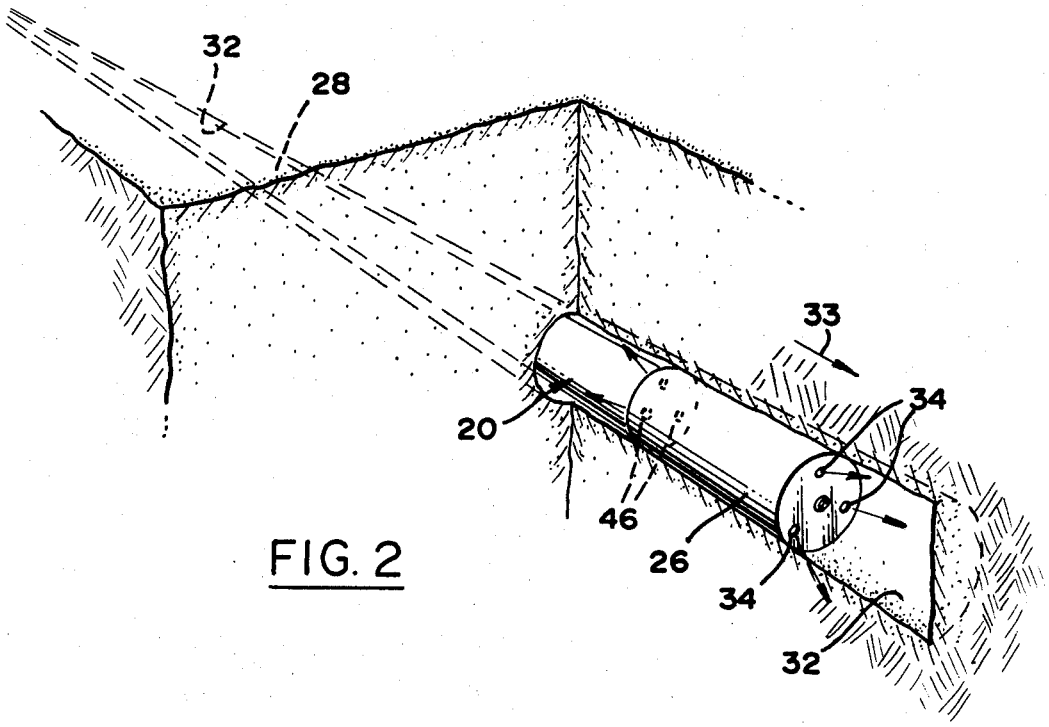
FIG. 2
FIG. 3
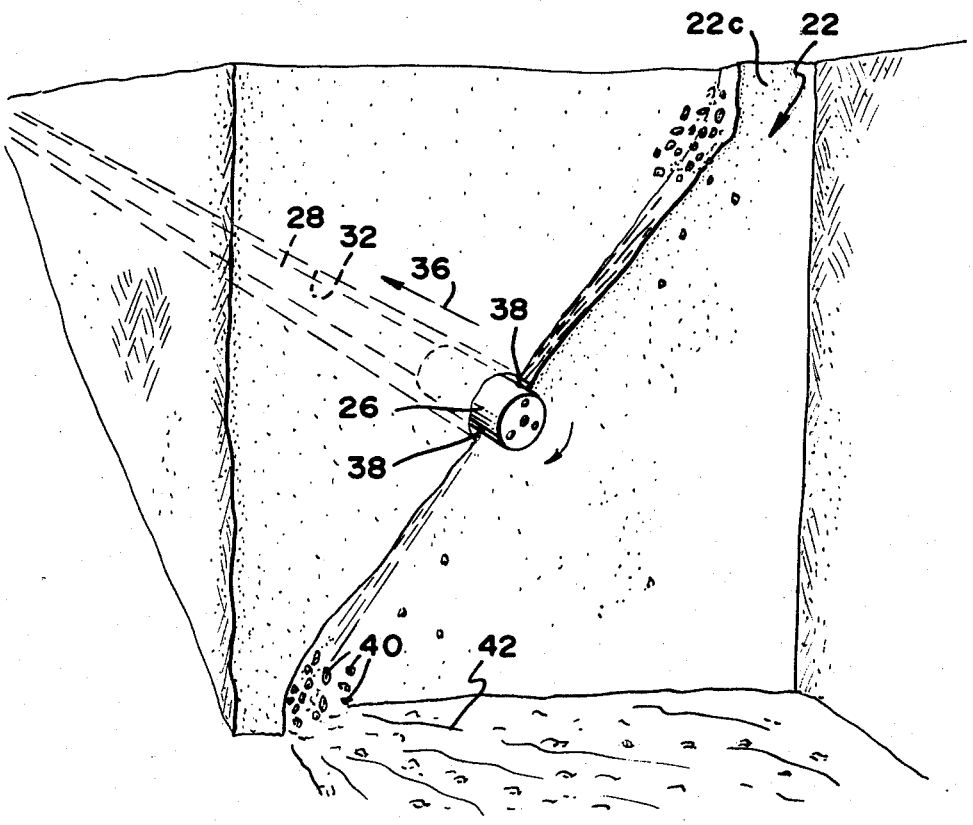

FIG. 4
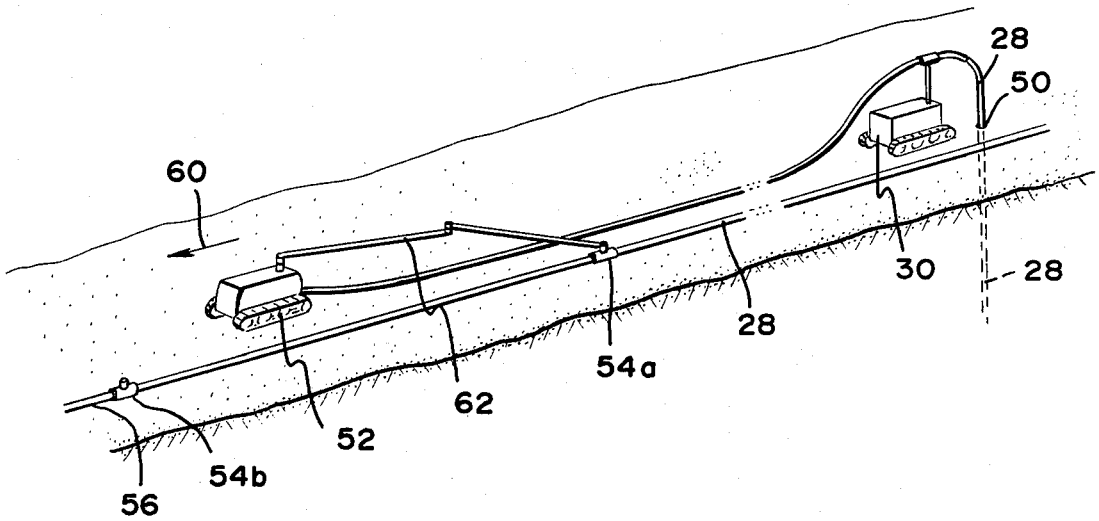
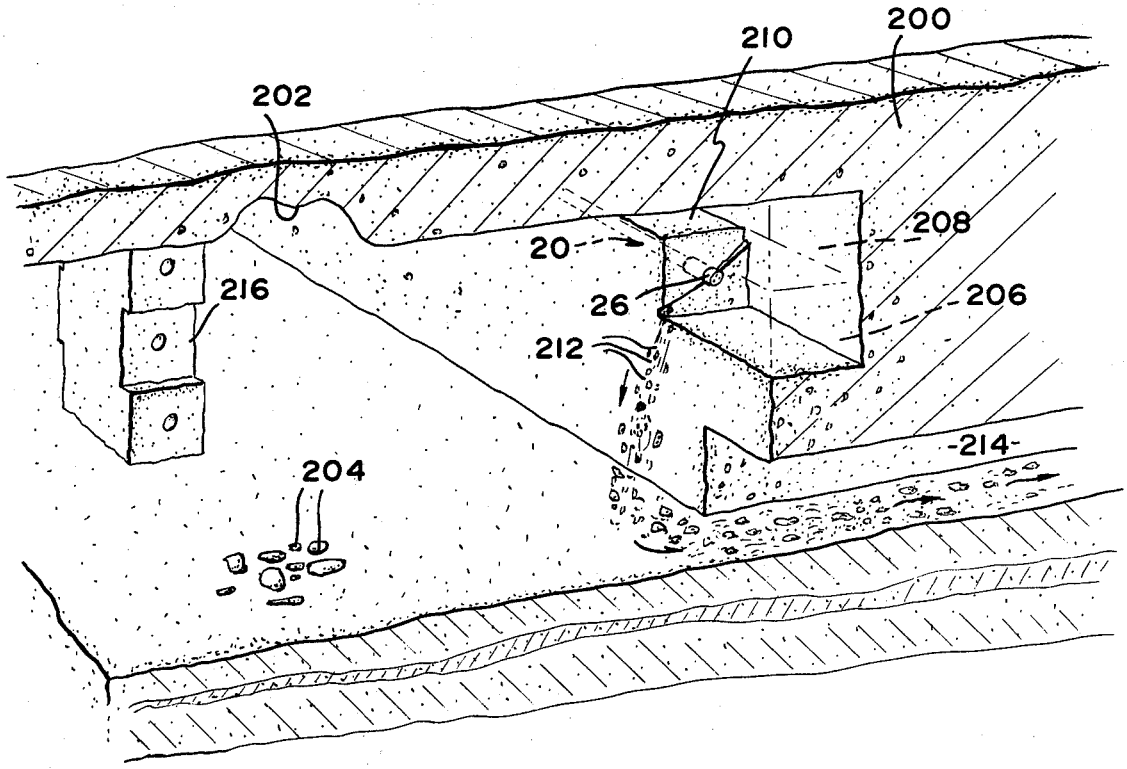
FIG. 8

FIG. 9
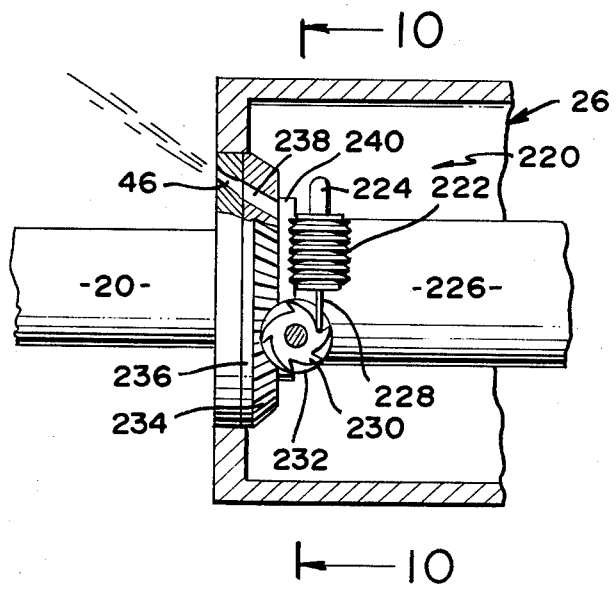
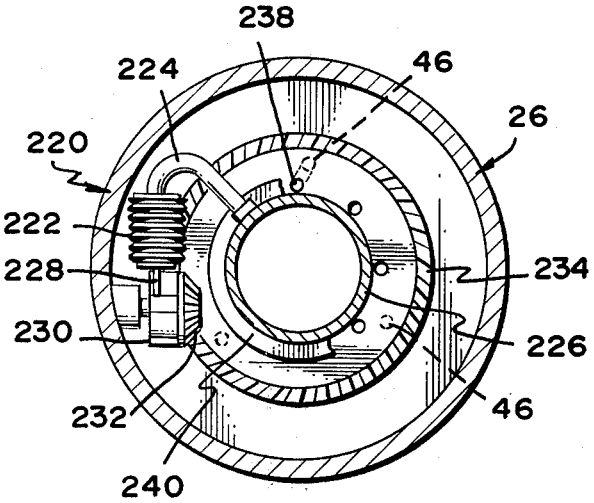
FIG. 10
FIG. 11
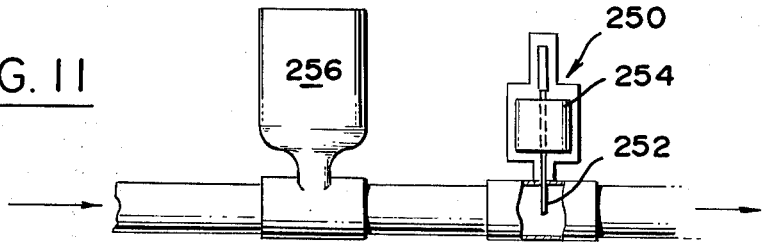

UNDERGROUND MINERAL EXTRACTION

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to methods and apparatus for use in extracting minerals from the earth.

The extraction of minerals such as coal from underground seams, has heretofore involved the placement of personnel underground at the working face of a mine to place explosives or operate mechanical cutters. If mineral seams such as coal seams, could be broken up by remotely controlled means, so that personnel would not normally be present in the mine, many advantages would result. It would then become possible to extract coal or other minerals from deeply pitched seams, from seams too thin for men to work in, from discontinuous, burning or gassy seams, or even in water filled or under water mines.

SUMMARY OF THE INVENTION

In accordance with one embodiment of the present invention, as underground mining method and apparatus is provided which enables the extraction of a mineral from the earth, the break-up of the mineral into small particles, and the raising of the mineral to near the surface for utilization or transport thereof, all without requiring the use of underground personnel. The coal is extracted by the use of an underground vehicle which is connected by a pipeline to the earth's surface and which emits high pressure water jets to break up the mineral. In one arrangement, the vehicle is utilized to form an underground drain gallery extending at an incline down to a lifting device which can lift minerals up to the earth's surface. The vehicle then is utilized to hydraulically cut tunnels or passages in the seam leading to the drain gallery, so that particles of the minerals mixed with water resulting from the cutting operation, can flow into the prepared drain gallery and then down along it to a lifting device that will lift the mineral to the earth's surface. Each passage can be formed by first using the vehicle to drill a pilot hole extending from an upper end of the seam down at an incline to the drain gallery, and then having the vehicle slowly withdraw backward along the pilot hole while directing high pressure water jets sidewardly to break up the mineral into small pieces and mix them with water. Successive pilot holes and passages are formed to progressively cut the mineral into particles that can flow down the grain gallery and be lifted to the earth's surface.

The water jet emitted from a nozzle on the vehicle for cutting or breaking up the mineral, can be made much more effective by the use of a vaporizable liquid added to the water upstream of the nozzle. A vaporizable liquid such as liquid carbon dioxide is added in separated droplets to the water stream prior to its ejection from the nozzle. The liquid carbon dioxide ($LCO_2$) remains liquid at ordinary temperatures when subjected to a high pressure above about 850 psi (pounds per square inch), which is less than perhaps a 5,000 psi pressure in the water stream moving towards the nozzle. As the water stream reaches the throat of the nozzle immediately prior to ejection towards the mineral seam, the water pressure decreases so that the $LCO_2$ almost instantly vaporizes to produce a small explosion. The explosion propels the water in front of the gaseous $CO_2$ bubble near the nozzle throat, towards the mineral seam with greatly added velocity, to more effectively break up the mineral. The use of $LCO_2$ has an additional advantage in that, when dissolved in water, it has a solvent action, so that its high pressure injection into microscopic cracks of a coal seam will cause it to loosen the bonds which bind the coal particles together. Accordingly, the next fluid jet hitting that region of the seam will be more effective in breaking it into more particles. The drops of vaporization material such as $LCO_2$ can be timed to produce pulses at a frequency equal to the resonant frequency of the face of the seam, to produce vibrations in the seam face that aid in breaking it up.

The novel features of the invention are set forth with particularity in the appended claims. The invention will be best understood from the following description when read in conjunction with the accompanying drawings.

BRIEF DESCRIPTION OF THE DRAWINGS

FIG. 2 is a sectional perspective view of the vehicle in the system of FIG. 1, shown during the drilling of a pilot hole through a seam.

FIG. 3 is a perspective sectional view of the vehicle of FIG. 2, shown during the combination operation wherein it breaks up a mineral lying around the pilot hole formed in FIG. 2.

FIG. 4 is a perspective view of a portion of the system of FIG. 1.

FIG. 8 is a partial perspective view of the underground mining system of FIG. 1, as utilized for a thick seam.

FIG. 9 is a partial sectional view of a portion of the jet head of the vehicle of FIG. 1.

FIG. 10 is a view taken on the line 10—10 of FIG. 9.

FIG. 11 is a partial sectional view of a portion of the system of FIG. 1.

DESCRIPTION OF THE PREFERRED EMBODIMENTS

Figure 1:
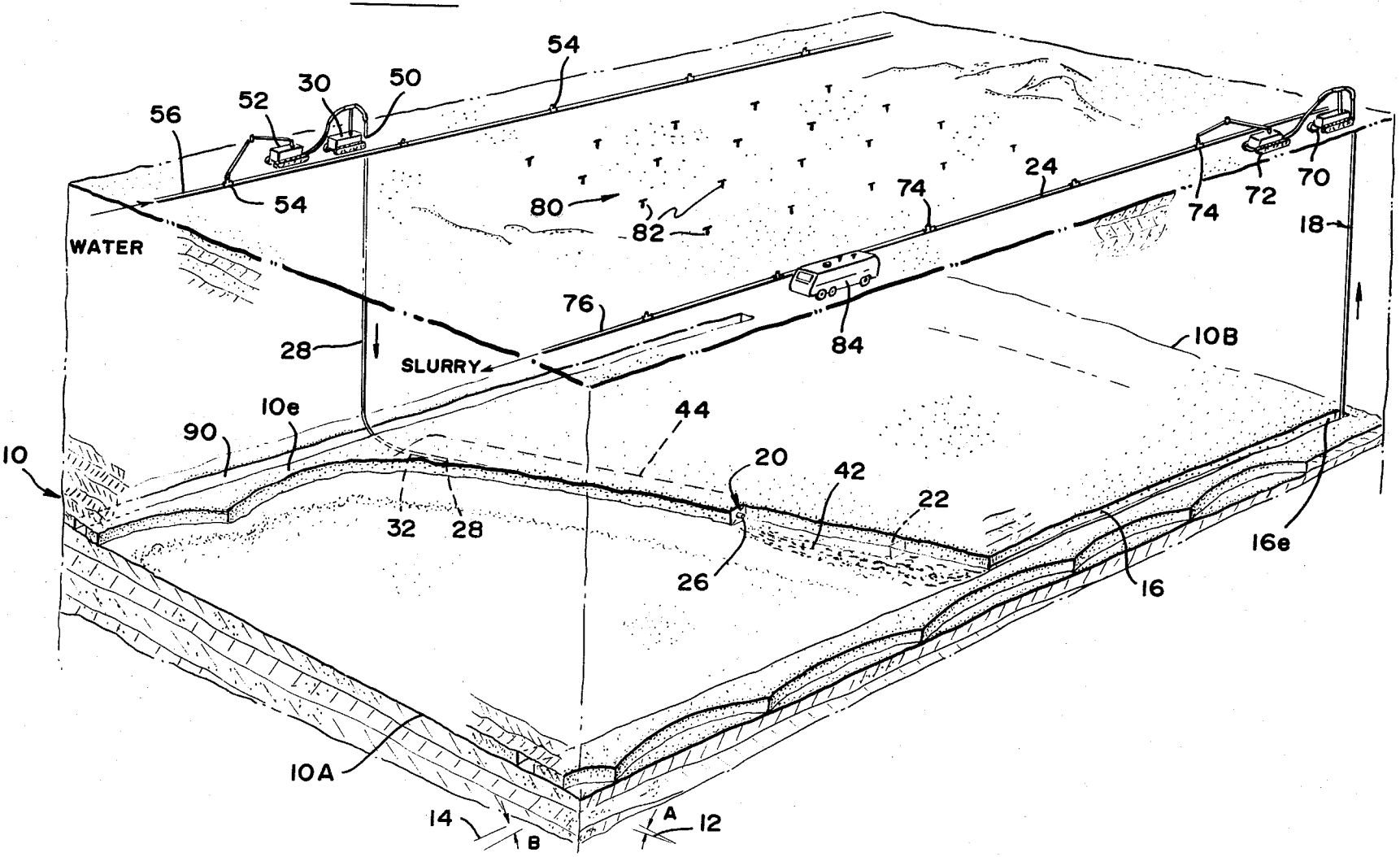
FIG. 1 is a perspective view of an underground mineral mining system of the present invention.

FIG. 1 illustrates a coal mining system which is utilized to mine a seam 10 of coal which is pitched at an angle A with respect to North-South horizontal line 12 and which is also pitched at an angle B with respect to an East-West horizontal line 14. In the illustrated system, a tunnel-like drain gallery 16 has been formed which extends from one side 10A to the other side 10B of the seam and at an incline, to permit the passage of coal to a lifting apparatus 18. A vehicle 20 is utilized to cut passages such as of the cross section indicated for a passage 22 with the passages extending at a downward incline towards the drain gallery 16. As each passage such as 22 is formed in the seam, the coal particles removed from the passage, which are mixed with water to form a coal slurry, flow down the passage to the drain gallery 16, and flow down the drain gallery to the lifting apparatus 18. The lifting apparatus 18 then lifts the coal slurry up the earth's surface where it is pumped into a coal slurry pipeline 24.

The vehicle 20 comprises a jet head 26 which can emit high pressure water jets to drill or otherwise break up the surrounding coal, and a pipeline 28 that extends behind the jet head to an upper end 10*e* of a portion of the coal seam, and then vertically up to a jet drill rig 30. The vehicle 20 is utilized to first drill a pilot hole 32 along the passage 22 from the upper end 10*e* of a seam portion, at a downward angle to the drain gallery. After the jet head 26 reaches the drain gallery, it is slowly withdrawn along the pilot hole while it directs fluid jets sidewardly to comminute (fracturing, and breaking into particles) the coal along the width of the passage 22, so that the coal particles mixed with water can flow down the passage to the drain gallery 16.

FIG. 2 illustrates the manner in which the jet head 26 of the vehicle is utilized to drill a pilot hole 32 along the center of a passage in the direction of arrow 33. The jet head 26 has drilling nozzles 34 that are directed in at least a partially forward direction. High pressure water pumped down the pipe line 28 to the jet head, is emitted through the jet nozzles 34 to impact the coal seam and break it into small particles. The particles of coal formed during the formation of the pilot hole are mixed with water to form a slurry that flows rearwardly behind the jet head as the jet head advances along the pilot hole 32 which it is drilling. The pilot hole is formed with a larger cross-section than the jet head to permit this flow. Then the pilot hole has reached the drain gallery 16, then the jet head 26 is operated in a different passage-enlarging mode, or comminution phase as shown in FIG. 3. In FIG. 3, the jet head 26 is retreating up the pilot hole 32 in the direction of arrow 36 while water is emitted from a pair of radially-directed jets 38 in the head, at a high velocity to break the coal into small pieces. The pipeline 28 is slowly rotated to rotate the jet head 26, but in a non-uniform way so that the head cuts a largely square passage, by turning the head more slowly as its jets are directed towards corners 22*c* of the passage. The particles such as 40 of coal are mixed with water, and flow as a slurry 42 down the cut passageway to the drain gallery.

FIG. 1 shows the jet head 26 retreating along a pilot hole 32 to form a passageway 22 while the coal slurry 42 if flowing down to the drain gallery 16 and therealong to the lifting apparatus 18. After the jet head as retreated to the upper end 10*e* of the seam portion, the jet head is redirected to move forward along a new path indicated at 44, which is parallel to the previously formed passage 22 and adjacent thereto, to form a new pilot hole extending to the drain gallery 18 and to cut a new passageway therealong.

The jet head 26 is controlled in direction by three reaction jets 46 (FIG. 2) that steer the jet head as it drills a pilot hole. Turning of the jet head during the communition phase is accomplished by turning the pipe line 28 leading to the jet head. All of this is accomplished by the jet drill rig 30 (FIG. 1) which feeds the pipeline down into a vertical hole 50 leading to the jet head while the jet head is drilling a pilot hole, and which withdraws the pipe 28 from the hole when the jet head is retreating along a pilot hole.

In order to accommodate large movements of the jet head, which require the feeding and withdrawing of large lengths of the pipe line, a separate jet pumper rig 52 is provided which supports portions of the flexible pipe extending from the jet drill rig 30 and coupled to valves such as 54 located along a water supply pipeline 56. FIG. 4 illustrates the manner of operation of the jet pump rig 52 in conjunction with the water pipe 56 and drill rig 30. As a length of pipe line 28 is drawn out of the hole 50 leading to the jet head, the pumper rig 52 moves in the direction of arrow 60 to pull out the pipe line 28. However the pumper rig 52 remains connected to the water line 56 by a flexible coupling 62 that connects the pumper rig to a valve 54*a* on the water line. The flexible couplings 62, which includes a pair of pivotally connected pipes whose ends are pivotally connected to the pumper rig 52 and valve 54*a*, enables pumper rig 52 to continue its connection to the water line while moving. However, when the coupling 62 becomes fully extended, operations cease while the coupling 62 is detached from one valve 54*a* to a next valve 54*b* along the water line. The valves 54 are spaced along the water line by slightly less than the length of the flexible coupling 62 to enable such reconnections to be made. When the pipe line 28 must be fed down into the hole 50, the pumper rig moves in the opposite direction and the flexible coupling 62 operates in a similar manner as in pipe line retraction.

The pipe line 28 can be referred to as a hose, since it is a conduit that has some flexibility and is bent and unbent in use to follow a curved path. This hose 28 can be formed of a spring steel, of a type which is well known. Such a pipe could be utilized in the present invention by rolling it into a coil, or by using a drilling tower. A coil would be inconvenient, inasmuch as the hose can be bent to only a large radius, and therefore a spool of a diameter such as 40 feet would be needed to wind up the hose without permanently deforming it. Such a windup spool would be very bulky, and therefore diffucult to transport and utilize. A drilling tower requires repeated connections of pipelength, which adds complexity and manpower requirements, as well as requiring the necessity for moving the tower at intervals.

The lifting apparatus 18 (FIG. 1) which lifts the coal slurry at the bottom of the drain gallery 16, can include a Myno pump. Such a pump can include a long pitch auger surrounded by a rubber sheath, so that coal particles are raised as the auger rotates, to lift the particles to the surface of the earth. A pair of counter rotating bevel gear-like cutters can be located at the bottom of the pump to grind any large particles reaching the bottom of the lifting apparatus so they fit into the rubber sheath of the Myno pump. A slurry drill rig 70 and slurry pumper rig 72 can be provided to couple to one of numerous valves 74 located along a slurry pipe line 76, so that the coal slurry can be easily transported to its destination.

In order to guide the jet head 26 so it drills along a next cutting gallery or passageway 44 (FIG. 1) it is necessary to have information as to the location of the jet head 26 and of the boundaries of the coal seam. This can be obtained by utilizing a phased array 80 of geophones 82 deployed on the surface of the earth above the extraction zone. The jet head 26 generates acoustic waves from a location of small volume as it is drilling a pilot hole, and these acoustic waves not only indicate the location of the jet head but also sonically illuminate the hole/rock interface around the coal seam as well as the boundaries of the passage already cut. The geophones 82 are connected to a central control mobile rig 84 which interprets the sounds sensed by the geophones to provide a continually updated image of the seam boundaries and the pilot hole location by computing apparatus well known in the art. This seismic imaging arrangement can provide significantly higher resolution images of the strata than is usual in the art of sonic location, because the acoustic source (the jet head) is always within a few feet of the interface being imaged. The jet head could be provided with a very high frequency hydraulically-powered acoustic source which could be valved on when necessary to generate acoustic signals, although $CO_2$ droplets can provide adequate acoustic illumination, as will be described below.

In the removal of coal from a large seam, extending under many acres the cutting galleries or passages 22, 44, are cut in sequence until a last passage is cut whose end lies near the lower end 16*e* of the drain gallery 16. Then, a next higher drain gallery 90 can be formed and the equipment, including the drill and pumper rigs 30, 52 and the slurry rigs 70, 72 as well as lengths of water and coal slurry hoses can all be moved along the surface of the earth to cut a next series of cutting galleries. Where the seam is deep, then after each cutting of a passage, a next passage below the previously cut one can be cut in the coal seam. Alternatively, after a series of horizontally spaced passages are cut, another series of passages can be cut lying immediately below the previous series. The coal comminuted during the cutting of each passage, will drop down and flow into a single drain gallery 16.

FIG. 8 illustrates the manner in which coal or other minerals can be cut from a relatively deep seam 200. An important danger that must be avoided is damage or loss of the vehicle 20 by reason of roof collapse. The figure shows a portion 202 of the roof which has collapsed into rubble 204. If the vehicle were lying in the roof portion 202, then the front end of the vehicle which includes the jet head, could be left dangling if the coal portion around it fell, and it might not be possible to then recover the vehicle. To avoid this, the seam can be cut in progressively lower passages. The vehicle 20 is shown cutting a passage 206 which lies below the previously cut passage 208. If a portion of the roof lying over passage 208 could collapse at a location directly above the vehicle, including the jet head 26 thereof, the rubble would merely fall on top of the surface 210 which lies over the jet head. The jet head and the rest of the vehicle would not be damaged by such rubble since all portions of the vehicle always lie within a protected area. The water and coal particles at 212 that are comminuted by the jet head, can reach the drain gallery 214 by flowing down the empty area where an adjacent column of passages were formed, to the drain gallery. It may be noted that where roof collapse must be avoided, pillars such as at 216, can be formed in the mineral seam, by interrupting the comminution phase as the jet head retracts along a predetermined location, during the movement of the jet head along a plurality of vertically spaced passages.

The jet head of the drilling and comminuting vehicle must be controlled by operators at the surface. This could be accomplished by transmission of electrical or electromagnetic waves through the pipeline or hose down to the jet head, but it is difficult to transmit such waves, and it might require a battery operated device in the vehicle to detect such signals, amplify them, and operate controls on the jet head. Instead, the signals can be transmitted down the hose by transmitting pressure pulses through the hose. FIG. 9 illustrates a portion of the jet head 26 showing the mechanism which responds to the pressure pulses to control the steering jets 46 at the rear of the jet head that steer the jet head. The controlling mechanism 220 includes a bellows 222 having one end connected by a pipe 224 to a conduit 226 in the jet head that carries the pressured water, so that the bellows 222 will contract and expand every time a pressure pulse passes through the pipe 226.

The end of the bellows opposite the pipe 224, carries a ratchet 228 that operates a ratchet wheel 230 to advance the wheel every time a pressure pulse passes through the hose 20 to the pipe 226. The ratchet wheel 230 turns a bevel or hypoid gear 232 which rotates another bevel or hypoid gear 234 attached to a rotatable valve member 236. The valve member 236 is in the form of a circular plate with holes 238 therein that can connect a manifold 240, connected to the water-carrying pipe 226, to the nozzles 46. Whenever one of the holes 238 in the valve member is aligned with one of the nozzles 46, water is emitted from the nozzle 46 to steer the jet head. As the ratchet wheel 230 turns, so that the valve member 238 turns, the three different nozzles 46 are connected to the pressured water in sequence. The mechanism can be constructed so that a given number of pulses such as three, is required to move the valve member 238 sufficiently to cover a previously connected nozzle 46 and bring a hole into alignment with another nozzle. By choosing the time period between each set of perhaps three pulses, an operator at the surface can determine how long water will be emitted from any one of the three nozzles, to thereby control the steering of the vehicle. A similar mechanism can be utilized to control other functions of the jet head, such as by providing a predetermined long length of pulses which will operate the other mechanism and cause it to disengage the steering control mechanism 220.

The pulses can be generated by a mechanism 250 as shown in FIG. 11, which comprises a gate valve member 252 operated by a solenoid 254, so that every time the gate member 252 moves across the pipe line or hose, it interrupts the flow to produce a pressure pulse. It may be noted that it is not necessary to completely close off the flow in order to produce a pulse, and that a partial closure of the flow will produce a pressure pulse that can be sensed and which can operate a mechanism at the jet head. The extraction system will typically include an accumulator 256 to minimize fluctuations in the pressure of the water, and such an accumulator can be located up-path from the pressure pulse mechanism 250.

Figure 5:
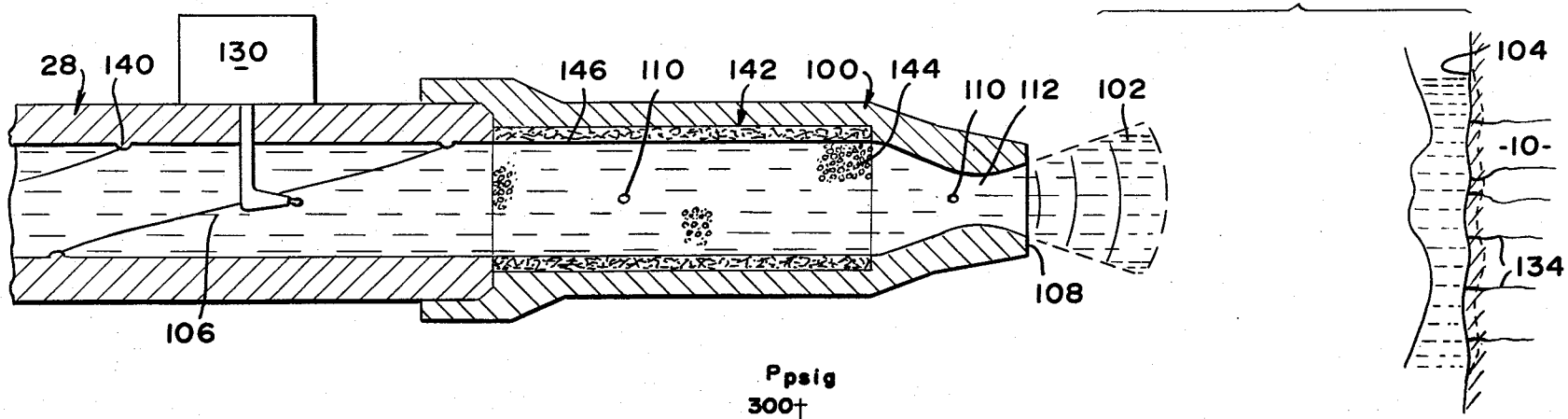
FIG. 5 is a sectional view of a nozzle of the vehicle of FIG. 2, showing the manner in which a vaporization liquid is utilized therewith to aid the fracturing of a mineral seam.

In order to break coal or other minerals away from adjoining portions of the seam, and to break the coal into small particles, it is necessary to generate a high velocity stream from the jets of the jet head. FIG. 5 illustrates one jet nozzle 100 of the jet head which emits a water jet 102 against a face 104 of the coal seam 10 to fracture the coal thereat. The water 106 can be pumped at a high pressure such as 5000 psi through the pipe line 28 leading to the nozzle 100 to produce a jet of relatively high velocity.

In accordance with another aspect of the present invention, a liquified vaporizable liquid is injected into the water stream which is passing towards the exit end 108 of the jet nozzle, which results in the production of a much higher velocity jet stream. Liquid carbon dioxide ($LCO_2$) can be utilized as the vaporizable liquid, which can be injected as spaced droplets 110 into the water stream 106. Carbon dioxide, which is a gas under normal temperatures and pressures, becomes liquid when subjected to a pressure above about 850 psi under normally encountered temperatures such as 70° F. Thus, when injected into a water stream 106 which is under a pressure such as 5000 psi, the $LCO_2$ droplet will remain liquid.

Figure 7:
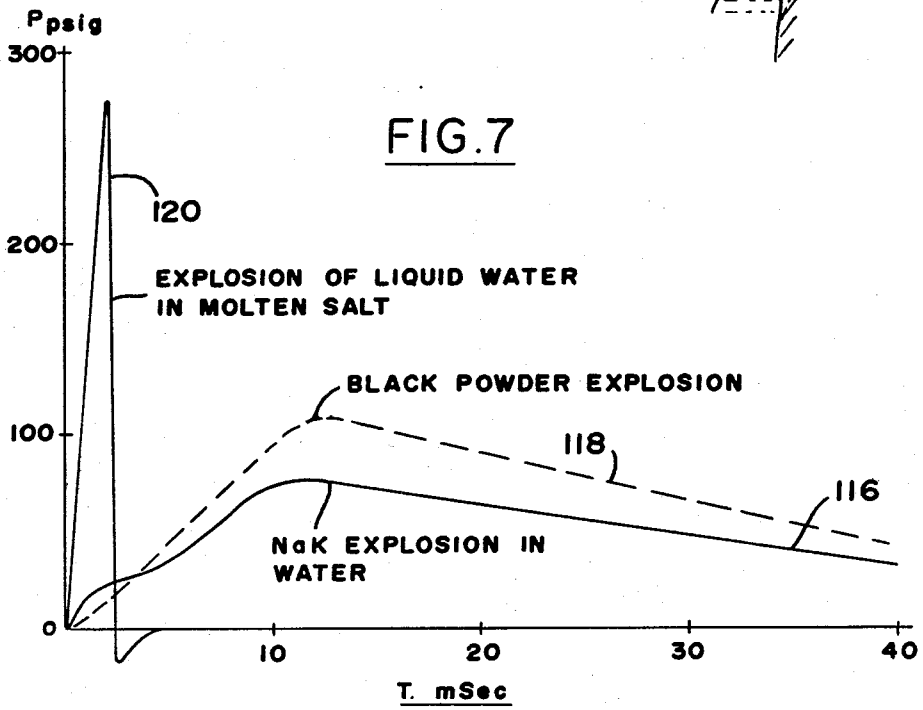
FIG. 7 is a graph showing the relative explosive characteristics of a vaporization liquid utilized in the present invention, and of common explosives.

When a $LCO_2$ droplet begins to enter the throat portion 112 of the nozzle 100, where the pressure of the liquid decreases to below 850 psi, the droplet will quickly vaporize, and in reverting to the gas phase of the $LCO_2$ droplet will give up considerable stored energy. The reversion to the gas phase of the droplet occurs very rapidly, even as compared to the evolution of gas in a conventional explosion, since reversion depends on expansion of the super critical $CO_2$ fluid resulting from decrease of the pressure of the surrounding water below the critical pressure. Since the equilibrium temperature at the reduced pressure is below the ambient temperature, the latent heat of vaporization is supplied by the sensible heat and the droplet does not depend on the relatively slow process of heat conduction for vaporization. The entire $CO_2$ droplet flashes into vapor in only the period of time needed for a pressure wave to traverse the length of the droplet. The time is far shorter than the burning time of an explosive. FIG. 7 provides graphs comparing the time required to reach peak pressure and showing the peak pressures which are reached, for comparable explosions resulting from detonation of explosives and vaporization of liquids. The graph 116 shows the time-pressure curve for an explosion of sodium-potassium and water, graph 118 shows the explosion characteristics of black powder explosive, and graph 120 shows the explosion characteristics of a liquid water droplet in a molten salt when the pressure is released to permit the droplet to vaporize. It can be seen that the vaporization explosion of graph 120 results in a much more rapid generation of pressure, and in the generation of a higher pressure than is produced by a conventional explosive such as a black powder explosion for the present type of conditions where the water slug in front of the explosion bubble is unconfined except by its inertia.

Figure 6:
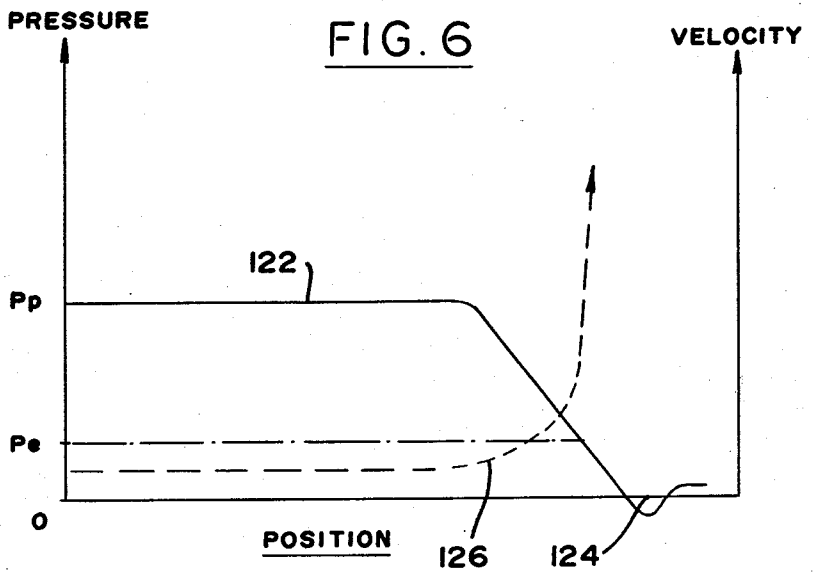
FIG. 6 is a graph showing the variation in pressure of the fluid in the nozzle of FIG. 5.

When the droplet 110 passes along the nozzle 100, (FIG. 5), then it encounters a decreasing pressure as it approaches the narrowest part of throat of the nozzle, where a very low pressure such as near zero may be encountered. Just prior to reaching the throat of the nozzle, the droplet 110 will encounter a pressure below 850 psi and suddenly vaporize. The gas produced by the sudden vaporization will drive the slug of water 102 lying in front of the exploding droplet 110 out of the nozzle, with a much greater velocity than a jet would emerge merely as a result of the 5000 psi pressure of the water. Each exploding srop near the throat of the nozzle 100 pneumatically drives a slug of pressurized water out of the nozzle with a force which is greater than would be achieved by hydraulic pressure alone. FIG. 6 provides a graph 122 showing the variation in pressure of the water in the absence of a vaporization droplet, showing that the water pressure remains about the same at a pressure $P_p$ of about 5000 psi until it comes near the throat of the nozzle, when the pressure continually decreases until it reaches a low value which may be below atmospheric pressure at a point 124 at the throat of the nozzle. The figure also shows a pressure $P_e$ which is the pressure such as 850 psi at which the vaporization liquid such as $LCO_2$ vaporizes. When the pressure curve 122 reaches the pressure $P_e$, the pressure no longer falls smoothly because a high pressure vapor is suddenly created. As a result, the velocity of the water is as indicated by graph 126, the velocity increasing as the throat of the nozzle is approached, and suddenly increasing when the vaporization liquid explodes.

Although the average pressure near the throat of the nozzle can fall to a low valve, it is possible for an $LCO_2$ droplet to avoid exploding. This can occur if the $CO_2$ is initially supplied at a very low temperature to keep it liquid without maintaining a high pressure around it. In that case, the water surrounding the $LCO_2$ will be much warmer than the $LCO_2$, so that as the surrounding pressure drops the outer layer of the $LCO_2$ may initially vaporize instead of exploding to thereby produce a localized high pressure which is not dissipated by water turbulance. Even if that occurs, the vaporization explosion will merely be delayed until the $LCO_2$ drop has left the nozzle and is approaching the coal seam, or when it impacts the coal seam, to produce an explosion which will be effective in comminuting the coal. The same type of effect can be obtained by injecting a liquid drop or solid pellet of a chemical explosive material which includes at least two chemicals that can rapidly chemically react to rapidly produce large quantities of gas, to thereby produce a chemical explosion. Such a chemically explosive material can be used which is reasonably stable, so that it does not explode until it hits the face of the mineral seam at a high velocity, such a high velocity being produced by the high pressure water carrying the material at a high velocity through the outlet nozzle.

The droplets 110 can be injected into the water stream by an injection device 130 coupled to the nozzle or to a pipe line portion upstream from the nozzle as in the pump rig. The pulsations of water result in each slug of water impacting the coal face 104 to effect a momentum transfer which compresses the coal face locally, with the rebound from this compression causing failure in tension in the form of mechanical spalling which results in coal separation from the mine face and comminution of the coal. The same result can be accomplished by the explosion of a drop or pellet at the mine face. The rate of injection of the droplets 110 or other small explosive charge into the water stream can be timed to equal the natural frequency of vibration of the coal face 104, so that larger vibrations of the coal face are produced to more easily separate the coal. The detection of the natural frequency of the vibration of the coal face can be accomplished by a variety of means such as by maximizing the amount of coal comminuted by the apparatus and pumped to the surface.

The impact of each slug of water on the mine face or explosion thereat, also helps to separate the coal from the mine face by driving pressured water into microcracks 134 in the coal. The pressured water in the microcracks tends to break up the coal immediately after the pressured water slug has hit the coal face and the outside pressure has dropped. The use of liquid carbon dioxide results in an additional effect aiding in the break up of the coal. Carbon dioxide and water form a solvent which dissolves coal. By driving gaseous $CO_2$ ($GCO_2$) and water into microcracks of the coal face, the fluid in the microcracks acts chemically on the coal face to loosen the bonds which bind the coal particles or grains together. The chemical dissolving action can require a brief period of time after the solvent is driven into the microcracks to loosen the chemical bonds of the coal particles. By utilizing a jet rotation of the type illustrated in FIG. 3, the water jets can impact each area of the coal face more than once. Thus, the first water jet impact which directly hits a portion of a mine face drive the $CO_2$ and water solvent into the microcracks, and the next impact at or adjacent to that area will occur after the chemical reactions have occurred and the coal is more friable so that the second impact will be sufficient to cause the dislodging of coal particles that were not dislodged in the first impact. The rotation of the jet head 26 at a rate such as two revolutions per minute, is sufficiently slow to provide time between water jet impacts on any mine face region to provide time for significant chemical reactions to occur.

The injection of the droplets 110 by the injector 130 is made im the middle of the water stream 106. In order to keep the droplet in the middle of the stream, so that it will tend to remain thereat near the throat of the nozzle outlet, the pipe line 28 can be provided with a helical rifing to provide a slow vortex action that keeps the drops in the center of the stream.

When each drop of $LCO_2$ explodes in the nozzle, a shock wave propagates not only forward to propel the water slug 102, but also rearwardly. Where the droplets 110 are spaced by long distances, the effects of the backward shock wave will be sufficiently dissipated to avoid the possibility of exploding, the next droplet. However, if the intervals between droplets are relatively short, it may be possible for the backward shock wave to cause the explosion of one or more following drops. This would prevent the discrete pulsing of the jet stream to negate the desired effects. To avoid early explosion of the drops 110, the nozzle can be provided with a shock absorbing layer to absorb the effects of a backward shock wave. This can be accomplished by providing a muffling device 142 in the nozzle which includes a perforated sheet 144 and a shock absorbing material such as steel wool 146 behind the sheet. The muffler 142 should be tuned to absorb and attenuate only the high frequencies associated with the very short spikelike shock waves which are the most energetic and most likely to detonate the following drops.

The extraction system described herein is useful primarily for coal or other minerals occurring in seams that are inclined by an appreciable amount such as at a strike of over 10°. This inclination permits coal slurry to easily flow down cutting passages and drain galleries. Many coal seams have such a strike, and are currently unminable by methods requiring underground personnel. The described mining system also permits mining of thin seams, discontinuous seams, burning or gassy seams, and water filled or underwater seams. The bulk of unminable coal occurs in such seams.

Thus, the invention provides a system for the mining of coal and other minerals occurring in a large variety of conditions, without requiring the use of personnel underground during normal mining. This can be accomplished by the use of a water jet-emitting vehicle, by using the vehicle to cut a drain gallery and then cutting successive passages leading to the drain gallery, to remove the mineral from the mine face and break it into small pieces for flow with water as a slurry to the bottom of the drain gallery where the mineral can be raised to the surface. The velocity of the water jets can be enhanced by the use of explosive pellets or liquids of a vaporizable liquid of a type which is a liquid under the high pressure of the water stream but which turns into a vapor when the pressure is reduced. A liquid carbon dioxide vaporization liquid can be utilized, which is especially useful in coal mining inasmuch as such a liquid combined with water, also serves as a solvent for the coal to aid in breaking up the coal. For ores and minerals other than coal, vaporization of liquids appropriate to the chemical nature of the ore can be choosen.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for extracting a mineral from the ground comprising:

applying a stream of liquid under pressure through a conduit having a nozzle directed at the mineral; and introducing a material to flow with said stream in said conduit and out through said nozzle, which is liquid under the pressure of said stream but which rapidly becomes a gas when the surrounding pressure is reduced below a critical pressure for that material, with the environment between the nozzle and mineral being at a pressure below said critical pressure.

2. The method described in claim 1 wherein:

said step of introducing includes repeatedly injecting discrete quantities of said material into said stream of liquid.

3. The method described in claim 1 wherein:

said material comprises carbon dioxide.

4. The method described in claim 1 including:

injecting said material as drops into said stream at a rate approximately equal to the natural frequency of the face of the mineral at which the stream is directed whereby to more effectively fracture the mineral.

5. The method described in claim 1 wherein said mineral is coal, and wherein:

said liquid comprises water and said material comprises carbon dioxide; and said step of applying includes applying said liquid stream at intervals to the same face area of said mineral, with said intervals long enough to allow time for the carbon dioxide and water which has been driven into cracks in the coal, to chemically act on the coal to loosen it, before again impacting that region of the coal.

6. The method described in claim 1 wherein:

said nozzle has inner walls that form a throat and that converge and diverge respectively toward and away from said throat.

7. A method for extracting a mineral from the ground comprising:

applying a stream of liquid under pressure through a conduit having a nozzle with a constricted area, which is directed at the mineral; and introducing into said stream at spaced times, discrete quantities of an explodable material which is stable against explosion when in the environment of said pressured liquid at a location upstream from the constricted area of the nozzle, but which can explode thereafter, and exploding said quantity of material downstream of said location but before said material reaches, and while it is travelling rapidly toward, said mineral, so the explosion helps propel the liquid against the mineral.

8. The method described in claim 7 wherein:

said material comprises a vaporizable liquid which remains substantially in a liquid state when maintained under the pressure at which said water is maintained upstream from said nozzle, but which rapidly vaporizes when the pressure around it drops to a lower level.

9. Mineral fracturing apparatus, comprising:

a water-carrying conduit, including an end forming a nozzle with a throat;

means for injecting separated drops of a vaporizable liquid which explosively vaporizes at normal atmospheric pressure into said conduit, to flow with water therein through and out of the nozzle and means for pumping said water through said conduit at a pressure exceeding the vaporizing pressure of the liquid, along the portions of the conduit which are at least the average diameter of the conduit.

10. The apparatus described in claim 9 wherein:

said conduit has an inner surface rifling, to help keep said drops near the center of the nozzle by vortex action.

11. The apparatus described in claim 9 wherein:

said nozzle includes converging and diverging regions locating respectively up-path and downpath of said throat, whereby the explosion of a droplet more effectively propels water lying immediately in front of the throat.

12. In a method for extracting an underground mineral by means of a device that emits water and moves underground, and that is connected through a hose that extends along a hole in the ground to a pumping rig on the ground, the improvement comprising:

establishing a water pipeline with a portion that extends along the ground in a direction away from the vicinity of said hole, with a plurality of couplings spaced along said pipeline portion;

establishing a hose handling means at said hole to guide said hose in movement into and out of said hole; and moving a pump along said pipeline while said pump holds and is connected to an end portion of said pipe, with the pump progressively connected to couplings spaced progressively along said water pipeline, while guiding said pipeline with respect to said hole in a loop or more than 90° by said hose handling means while it lies near said hole.

13. A method for extracting an underground mineral comprising:

moving a vehicle in a first direction through a pilot hole extending along a passage to be formed, and then along an opposite direction through said pilot hole while comminuting the mineral in said passage, along successive substantially parallel passages extending in a primarily horizontal direction, with at least pairs of said passages primarily vertically spaced from one another; and each lower passage which lies immediately below another higher passage, being formed after said higher passage, so that the vehicle is not vulnerable to damage from roof collapse.

14. The method described in claim 13 wherein:

said passages are inclined from the horizontal; and including forming an inclined drain gallery substantially perpendicular to said passages along the lower end of said passages and near the level of the lowermost of said passages; and wherein said step of moving said vehicle includes forming a plurality of passages successively under one another, and then forming an adjacent plurality of passages successively under one another, so that the comminuted mineral of a higher passage can fall into the space left by the previously formed plurality of vertically spaced passages to reach the drain gallery.

15. In a remote underground mineral extraction system which includes an underground water-emitting device, and a water source near the earth's surface, the improvement comprising:

a water conduit coupling the water source and water-emitting device;

valve means disposed at said device and responsive to fluid pressure pulses for controlling water emission from said device;

a pipe having one end connected in parallel to said water conduit and another end connected to said valve means to transmit the water pressure to said valve means without the pipe affecting the free flow of water along said conduit towards the water emitting device; and means located near the earth's surface for generating pressure pulses in the water in said conduit.

16. The improvement described in claim 15 wherein:

said valve means comprises a bellows, a ratchet movable by said bellows, a ratchet wheel which is turned by said ratchet, and a valve member moved by said ratchet wheel.

17. The improvement described in claim 16 wherein:

said device comprises a plurality of jet nozzles directed in different directions to turn said device; and said valve member is rotatable and has a hole that couples different ones of said jet nozzles to said conduit as the valve member turns.

18. A method for extracting an underground mineral, comprising:

comminuting said mineral along a plurality of successive elongated passages, with each successive passage lying substantially parallel to and adjacent to the prior passage, and with the lower ends of at least some of the passages lying substantially along an inclined drain gallery that extends largely perpendicular to said passages;

mixing fluid with said mineral to form a slurry; and raising said mineral to near the ground level from a location along said inclined gallery;

said steps of comminuting and mixing including emitting a high pressure stream of water in a largely sideward direction with respect to the length of a passage, from a vehicle moving along the middle of the passage, including turning at least the water-emitting portion of said vehicle about an axis substantially coaxial with the length of the passage.

19. Mineral fracturing apparatus, comprising:

a water-carrying conduit, including an end forming a nozzle with a throat;

means for injecting separated drops of a vaporizable liquid into said conduit, to flow with water therein through and out of the nozzle; and shock absorbing means including multiple holes formed in the inner surface of said nozzle along a portion thereof which lies up-path from the throat, whereby to prevent the explosion of a drop of said vaporizable liquid near the throat from causing the premature explosion of the next drop.

20. A method for extracting an underground mineral, comprising:

comminuting said mineral along a plurality of successive elongated passages, with each successive passage lying substantially parallel to and adjacent to the prior passage, and with the lower ends of at least some of the passages lying substantially along an inclined drain gallery that extends largely perpendicular to said passages;

mixing fluid with said mineral to form a slurry; and raising said mineral to near the ground level from a location along said inclined gallery;

said steps of comminuting and mixing including emitting a high pressure stream of water in a largely sideward direction with respect to the length of a passage, from a vehicle moving along the middle of the passage, including turning at least the water-emitting portion of said vehicle about an axis substantially coaxial with the length of the passage, and emitting more water at 90° spaced positions than halfway between said positions, whereby to form a largely square cross-section passage.

* * * * *